US006672024B2

(12) United States Patent
Alderman

(10) Patent No.: US 6,672,024 B2
(45) Date of Patent: Jan. 6, 2004

(54) SYSTEM FOR APPLYING HEAT INSULATION TO A ROOF STRUCTURE

(76) Inventor: Robert J. Alderman, 686 Highland Ter., Canyon Lake, TX (US) 78133

( * ) Notice: Subject to any disclaimer, the term of this patent is extended or adjusted under 35 U.S.C. 154(b) by 0 days.

(21) Appl. No.: 10/096,119

(22) Filed: Mar. 8, 2002

(65) Prior Publication Data

US 2003/0167730 A1 Sep. 11, 2003

(51) Int. Cl.[7] ..... E04B 1/74

(52) U.S. Cl. ..... 52/407.3; 52/404.1; 52/404.3; 52/407.5; 52/478; 52/409

(58) Field of Search ..... 52/404.1–404.3, 52/407.3–407.5, 408–410, 478, 483.1, 746.11, 749.12

(56) References Cited

U.S. PATENT DOCUMENTS 3,559,914 A * 2/1971 Alderman ..... 242/86.52
3,969,863 A * 7/1976 Alderman ..... 53/407
4,047,345 A * 9/1977 Alderman ..... 52/404
4,075,807 A * 2/1978 Alderman ..... 52/407
4,078,355 A * 3/1978 Clemensen ..... 52/747
4,147,003 A * 4/1979 Alderman ..... 52/309.8
4,222,212 A * 9/1980 Alderman ..... 52/749
4,967,535 A * 11/1990 Alderman ..... 52/749
5,551,203 A * 9/1996 Alderman et al. ..... 52/746.11
5,561,959 A * 10/1996 Alderman et al. ..... 52/407.3
5,878,474 A * 3/1999 Yasnogorodskiy et al. .... 20/431

* cited by examiner

*Primary Examiner*—Carl D. Friedman
*Assistant Examiner*—Yvonne M. Horton
(74) *Attorney, Agent, or Firm*—Thomas, Kayden, Horstemeyer & Risley

(57) ABSTRACT

Roof insulation applicator (10) for applying blanket insulation or other sheet material to the roof of an industrial building includes a carriage (12) for mounting on adjacent purlins (14 and 15) of a partially completed roof. Support roller (40) is applied by the carriage to the upper surfaces of the purlins (14 and 15) and the carriage is tiltable about the support roller (40). The center of gravity of the carriage (12) is applied rearwardly of the support roller (40), between the support roller (40) and the rear of the carriage. Purlin engager (60) is mounted to the front of the carriage and engages under the upper laterally extending flange (22) of the purlin (14). The purlin engager at the front of the carriage limits the downward pivoting of the rear end of the carriage so that a lever arm effect is applied by the weight of the rear portion of the structure to the support roller (40). This applies an amplified downward force to the support roller (40) that is transferred to the side edges of the sheet material (55) and to the purlins, firmly holding the sheet material in its stretched configuration extending from the roof panel (16) out to the support roller (40), reducing the tendency of the sheet material to sag in between the adjacent purlins, and assuring that the wind and vibration about the building will not disrupt the installation of the sheet material to the roof.

19 Claims, 3 Drawing Sheets

SYSTEM FOR APPLYING HEAT INSULATION TO A ROOF STRUCTURE

FIELD OF THE INVENTION

This invention relates to the progressive application of flexible sheet material, such as blanket insulation, to the purlins of a roof during the progressive construction of a roof of an industrial building. More particularly, the invention involves a carriage for carrying a reel of flexible sheet material along adjacent purlins of a roof and dispensing the sheet material onto the purlins in response to the movement of the carriage.

BACKGROUND OF THE INVENTION

The roof structure of an industrial building typically includes inclined rafter beams that extend parallel to each other and horizontally oriented purlins mounted on the rafters that extend parallel to each other in a direction normal to the rafters. The purlins are supported by the rafters, and flexible sheet insulation such as fiber glass blankets are spread over the purlins. The lengths of the blankets extend normal to the purlins. Hard roof panels are applied on the insulation and connected to the purlins.

In recent years, flexible insulation blankets have been applied to industrial buildings by orienting the lengths of the blankets parallel to the purlins and placing the opposed side edges of the blankets on the tops of the purlins so that the blankets span the spaces between the purlins. In order to apply the blanket insulation to the purlins, a reel support carriage such as those disclosed in U.S. Pat. Nos. 3,559,914, 3,969,863, 4,075,807, 4,147,003, and 4,967,535 can be mounted on the purlins of the roof for supporting one or more reels of blanket insulation. The reel support carriage, sometimes known as a "roll stand," is guided by adjacent ones of the purlins and supports a reel of blanket insulation above the space between the adjacent purlins. The workers stand on the hard roof panels that already have been applied to the purlins and push the carriage with a push bar farther along the purlins to apply the blanket insulation as the blanket unrolls itself in response to the motion of the carriage. When the carriage has been pushed far enough away from the last applied roof panels, additional roof panels are applied to the purlins, and the procedure continues.

This procedure of applying sheet material to the purlins during the construction of a roof has the advantage of mounting the edges of the blanket insulation on top of the purlins so that there are no seams between adjacent insulation blankets that are directly exposed to the space below the roof. This helps avoid the penetration of heat, moisture and other items carried by the environment within the building through the seams between the blankets to the roof panels, and tends to avoid deterioration of the roof panels.

Some of the problems with the use of carriages for applying blanket insulation to the purlins of a roof structure are guiding the carriage along the purlins, maintaining the carriage in proper position to apply the sheet material to the purlins, and maintaining the sheet material in a stretched configuration extending rearwardly from the carriage back to the position of the last applied roof panel so as to avoid the sagging of the insulation material between the purlins before the next roof panel can be applied.

Another problem with the prior art carriages is that the typical roof structure has various obstructions that extend in or adjacent the path of movement of the carriages as the carriages progress along the purlins, and the carriages must be lifted over the obstructions. It is difficult to move the carriages over or about the obstructions and usually requires the carriages to be detached from their purlins, moved beyond the obstruction, and then reattached to the purlins so as to continue safe movement along the lengths of the purlins.

Another problem with the prior art carriages is that when there is a wind present, the wind is likely to disturb the blanket insulation extending from a carriage back to the position of the last applied roof panel, making it difficult to properly apply the insulation.

It is to the solution of these problems that this invention is devoted.

SUMMARY OF THE INVENTION

Briefly described, the present invention involves a roof insulation applicator for applying flexible sheet material, such as blanket insulation, to a roof structure of an industrial building, whereby the sheet is applied parallel to the purlins with the edges of the sheet resting on the top surfaces of the purlins and fastened to the purlins by the hard roof panels and their fasteners.

In a preferred form of the invention, one or more reel support carriages are mounted to adjacent purlins of the roof before the roof panels are applied, and the carriage is moved progressively along the purlins. A reel support is mounted on the carriage for supporting a spiral reel of flexible sheet material on the carriage. The reel of flexible sheet material, such as heat insulation blanket made of fiberglass or other particulate material, heat reflective sheet material, and phase change material, is supported by the reel support for dispensing from the carriage onto the upper surfaces of the purlins. A support roller is mounted on and extends laterally across the bottom of the carriage for supporting the carriage on adjacent purlins of the roof, and the carriage is tiltable about the support roller.

As the carriage is moved forwardly along the purlins, away from the previously applied roof panels, the free end of the flexible sheet extending from the reel supported on the carriage pays out from the reel, moves about the support roller and is applied to the top surfaces of the purlins at a position beneath the carriage. The opposed side edges of the sheet are applied to the top surfaces of the purlins, and the support roller of the carriage rolls over these side edges, thereby urging the edges of the sheet into frictional engagement with the purlins.

The carriage and the reel support are configured so that the center of gravity of the carriage, the reel support and the reel of sheet material supported on the reel support is positioned between the rear of the carriage and the support roller. This applies a downward tilting force to the rear of the carriage about the support roller so that the forward portion of the carriage tends to tilt upwardly.

A purlin engager is mounted to the front of the carriage for slidably engaging the upper flange of one of the purlins on which the support roller engages. The purlin engager holds the carriage on the purlin, and the purlin engager limits the upward tilting of front of the carriage, and therefore limits the downward tilting of the rear of the carriage. The longitudinal off set of the center of gravity of the carriage from its support roller causes the weight of the assembly to apply leverage about the support roller, forcing the support roller into firm engagement with the upper surfaces of the purlins on which the carriage rests.

The additional leverage applied to the support roller by the offset center of gravity as described above adds additional downward force being applied to the edges of the sheet material against the upper surfaces of the purlins, thereby assuring that sufficient force is applied to the insulation material. This results in the sheet resisting the forces of wind and weight so as to avoid sagging of the sheet between the purlins and inadvertent paying out of the sheet from the reel.

When the carriage is advanced along the purlins to a position where an obstruction is in the path of the carriage, the operator can tilt the rear end of the carriage upwardly, resulting in a downward tilting of the front end of the carriage about the support roller. This downward tilting of the front end of the carriage also tilts the purlin engager downwardly, so that it can be easily removed from engagement of the purlin by rotating the carriage laterally, so as to laterally displace the purlin engager from the purlin. The carriage is now free to simply roll over or to be lifted over the obstruction. When the carriage is moved beyond the obstruction, again it is a simple matter of tilting the front end of the carriage downwardly so as to move the purlin engager back beneath the purlin, and then rotating the carriage slightly so that the purlin engager moves laterally beneath the upper flange of the purlin and tilting the carriage back to its normal attitude to again engage beneath the upper flange of the purlin.

In order for a worker to control the movement of the carriage along the lengths of the purlins, a push pole is provided to the worker, so that the worker can stand on the previously installed hard roof panels and, by manipulation of one end of the push pole, engage the carriage with the other end of the push pole, and push the carriage along the purlins as needed. In addition, the carriage includes a pole lifting hook for engaging an intermediate portion of the pole so that the pole can be tilted upwardly against the lifting hook, causing the rear portion of the carriage to tilt upwardly. This results in the front end of the carriage tilting downwardly about the support roller, so that the purlin engager can be connected to or disconnected from the upper flange of its purlin.

DETAILED DESCRIPTION

Figure 1:
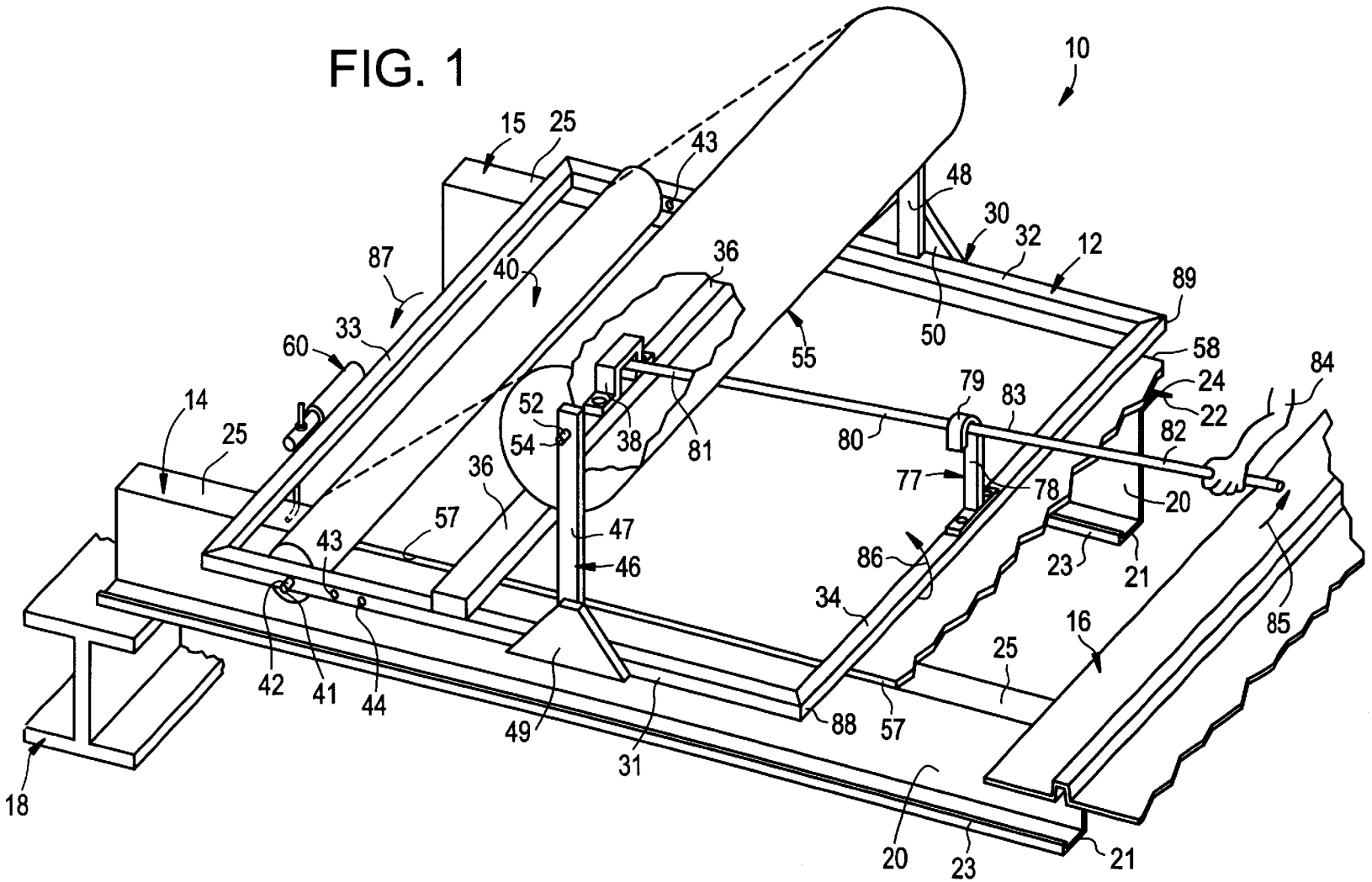
FIG. 1 is a perspective illustration of the roof insulation applicator.
Figure 2:
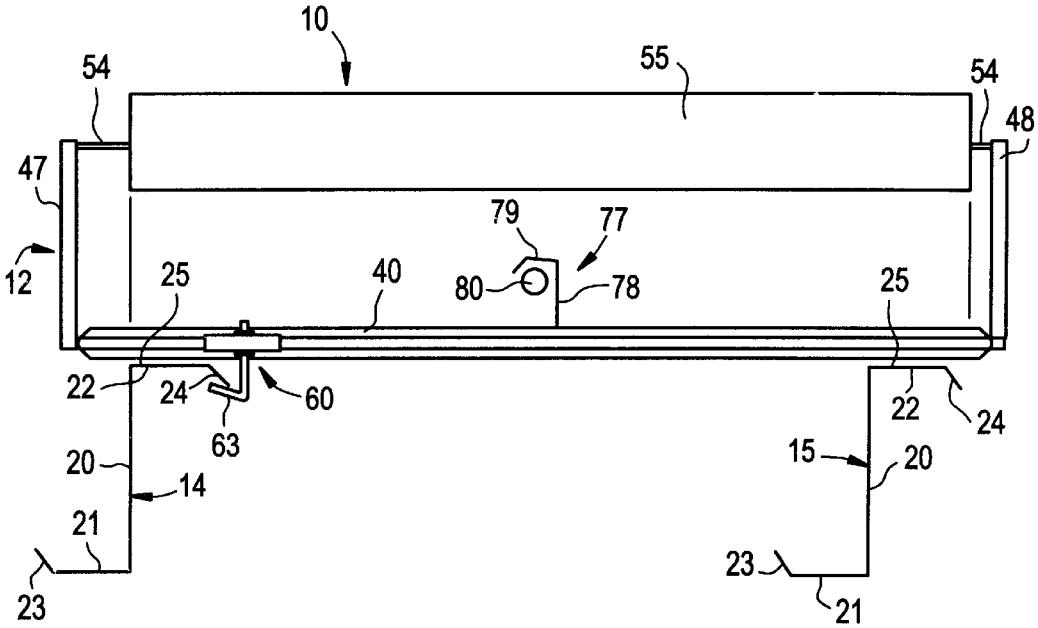
FIG. 2 is a front elevational view of the support carriage.
Figure 3:
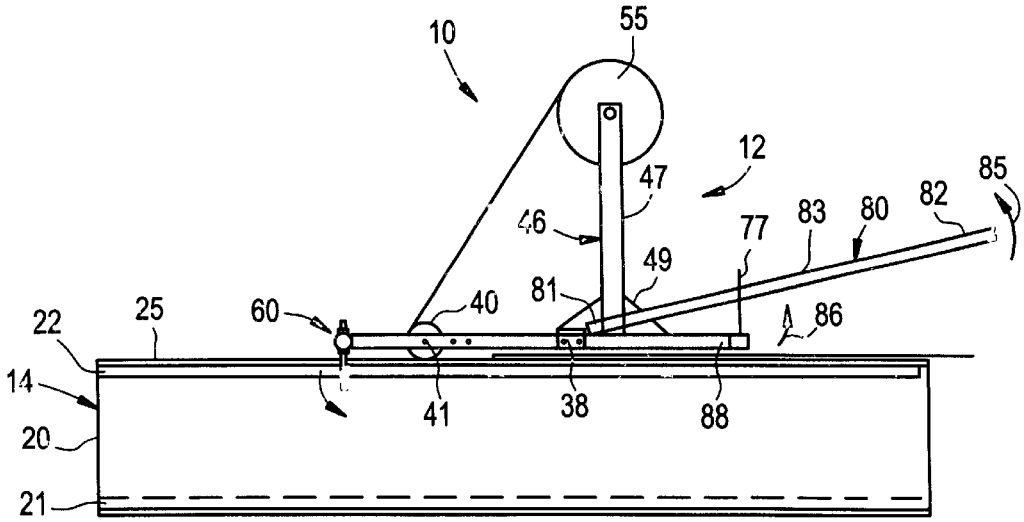
FIG. 3 is a side elevational view of the support carriage.

Referring now in more detail to the drawings in which like numerals indicate like parts throughout the several views, FIG. 1 illustrates the roof insulation applicator 10 that progressively applies blanket insulation or other sheet material to the upper surfaces of adjacent purlins 14 and 15 of the roof as the hard roof panels 16 are progressively applied to the sheet material and to the purlins at a position behind the applicator. The applicator 10 includes a support carriage 12 for mounting on adjacent, parallel purlins 14 and 15 of a partially completed roof structure. The purlins rest on inclined rafters 18 of the roof in the conventional manner.

The rafters 18 and purlins 19 are of conventional construction, with the rafters being of I-shaped cross section, and the purlins of a stretched Z-shaped cross section. The purlins include an upright central web 20, a lower laterally extending flange 21 and upper laterally extending flange 22, with the flanges 21 and 22 extending in opposite directions from the lower and upper edges of the central web. An edge strengthening flange 23 is oriented at an inclined angle with respect to lower laterally extending flange 21, and a similar edge strengthening flange 24 is inclined from upper laterally extending flange 22. The upper laterally extending flange 22 of the purlin forms an upper surface 25 on which the support carriage can be mounted. The lower laterally extending flange 21 forms a lower surface 26 that rests on the rafters 18. The purlins of the roof are uniform in shape and dimensions.

Carriage 12 includes a rectangular framework 30 having opposed, parallel side beams 31 and 32, and opposed front and rear lateral beams 33 and 34, each joined at its ends to adjacent beams to form a framework that is of sufficient breadth to span at least adjacent ones of the purlins 14 and 15. Stabilizer bar 36 extends laterally across the framework, and is joined at its ends to the opposed side beams 31 and 32. Pole receptacle 38 is mounted on stabilizer bar 36 and forms a pocket in which the end of a push pole can be received.

Support roller 40 extends laterally across the framework 30 and is supported by axles 41 in the side beams 31 and 32 of the framework. The axles extend through aligned openings, such as openings 42–44 in the side beams 31 and 32, so that the support roller can be repositioned along the length of the framework, as may be desired. Other adjustable roller supports can be used, such as sleeves telescopically mounted about the side beams 31, 32 having axle receptacles for receiving the axles 41. A reel support 46 is mounted on the side beams 31 and 32 of the framework 30. The reel support 46 includes a pair of upright stanchions 47 and 48, with the lower ends of the stanchions mounted on the side beams 31 and 32, respectively, with support gussets 49 and 50 stabilizing the stanchions with respect to the side beams 31 and 32. The upper ends of the stanchions 47 and 48 define aligned openings, such as opening 52, and reel support bar 54 extends through the openings 52.

A reel of sheet material 55 is mounted on an axle 54, and the axle is threaded into the axle openings 52 and 53, so as to support the reel of sheet material 55 above the carriage 12 and over the space between adjacent purlins. The free end of the sheet material is extended from the reel 55, inclined downwardly and then about the support roller 40 and longitudinally onto the upper surfaces 25 of the adjacent purlins 14 and 15. The width of the reel of sheet material is sufficient so that the sheet material spans the space between adjacent purlins, and the edges of the sheet will be applied to the upper surfaces 25 of the purlins.

Figure 4:
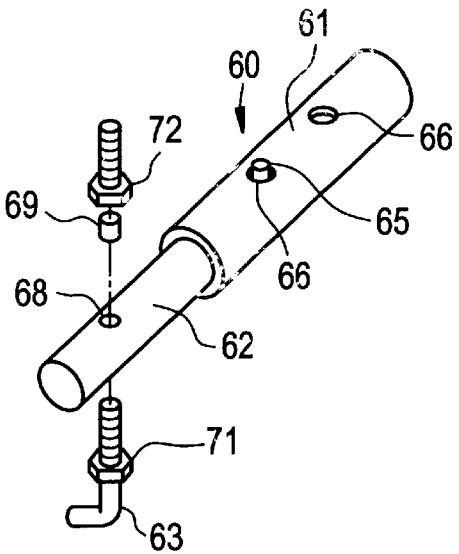
FIG. 4 is a perspective illustration of the purlin engager.

Purlin engager 60 is mounted on front lateral beam 33 of the rectangular framework 30. As best shown in FIG. 4, the purlin engager 60 includes open-ended mounting sleeve 61, hook support bar 62, and engager hook 63. The open-ended mounting sleeve 61 is rigidly mounted by welding or other rigid connection to and its longitudinal axis extends parallel to the front lateral beam 33, leaving the hook support bar free to rotate and telescope with respect to the mounting sleeve 61. A spring loaded positioning finger 65 is carried by the hook support bar 62 and registers with one or more of the openings 66 formed in the mounting sleeve 61. With this arrangement, the longitudinal and rotational positions of the hook support bar 62 can be adjusted with respect to the open-ended mounting sleeve 61, as may be desired.

Figure 5:
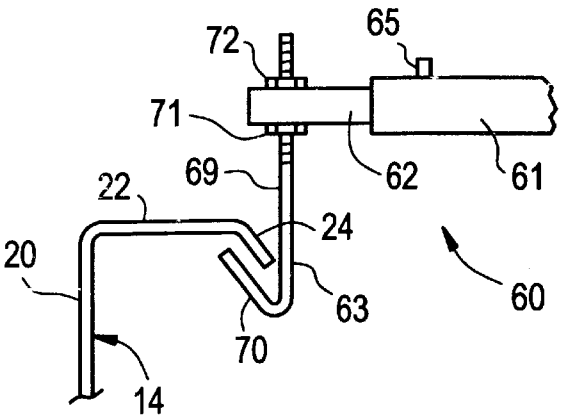
FIG. 5 is an elevational view of a purlin engager, showing how it engages the upper flange of a purlin.

Hook support bar includes at its distal end a hook opening 68 that extends therethrough, for the mounting of the engager hook 63. Engager hook 63 includes a rectilinear shank 69, threaded along its length, and a hook 70 at the lower end of the shank. As shown in FIG. 5, the angle made between the protrusion of the hook 70 and the rectilinear shank 69 approximately matches the angle made by the strengthening flange 24 of the upper laterally extending flange 22 of the purlin 14. Lock nuts 71 and 72 engage the threads of the shank 69 above and below the hook support bar 62 so as to rigidly connect the purlin engager hook 63 to the purlin engager 60. Also, the lock nuts permit the engager hook 63 to be adjusted with respect to the hook support bar 62.

Figure 6:
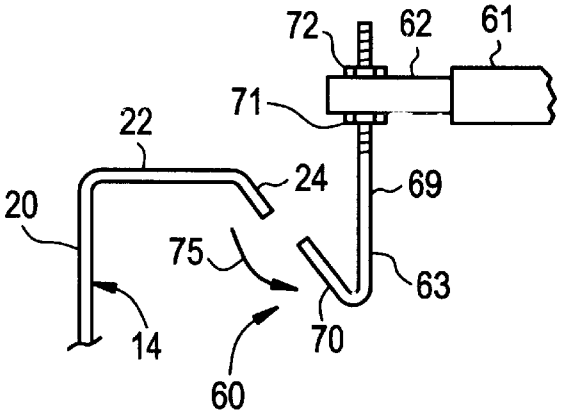
FIG. 6 is an elevational view of a purlin engager, showing how the purlin engager is moved downwardly and laterally in order to disengage from a purlin.

As illustrated in FIG. 5, this length adjustment is made so that the engager hook 63 will be positioned so that it is placed in sliding relationship with respect to the strengthening flange 24 and upper laterally extending flange 22 of a purlin 14. As shown in FIG. 6, the purlin engager 60 can be disengaged from the upper laterally extending flange 22 and its strengthening flange 24 by moving the purlin engager 60 downwardly and laterally, as indicated by arrow 75.

Lifting hook 77 is mounted to rear lateral beam 34 of the framework 30 of the carriage, with the shank 78 of the lifting hook mounted to the lateral rear beam 74 and the curl of the lifting hook 79 facing downwardly.

A rectilinear push pole 80 has a distal end 81 that is to be engaged with pole receptacle 38, so that the push pole can be manipulated at its proximal end 82 by a worker 84 to push the carriage 12 farther along the purlins 14, 15. Also, the intermediate portion 83 of the push pole 80 can engage the curl 79 of the lifting hook 70, and the worker 84 can lift the proximal end of the pole as indicated by arrow 85, to urge the lifting hook upwardly and tilt the rear end of the framework 30 upwardky, as shown by direction arrow 86. This results in tilting the front end of the framework downwardly in the direction as indicated by direction arrow 87.

It will be noted that the support roller 40 is positioned forwardly of the mid point of the framework and the reel support 46 is displaced rearwardly with respect to support roller 40, so that most of the weight of the framework 30, the weight of the reel support 46,and the weight of the reel of sheet material 55 will have a center of gravity that is applied rearwardly of the support roller 40, causing the rear portion of the carriage to tilt downwardly about the support roller 40, opposite to the direction indicated by direction arrow 86, so that the rear corners 88 and 89 of the framework tend to move toward their respective purlins 14 and 15. However, purlin engager 60 reaches beneath the upper laterally extending flange 22 of purlin 14, as shown in FIG. 5, so as to limit the downward pivoting of the rear end of the framework 30.

Operation

When the sheet applicator 10 is to be used to apply sheet material, such as fiberglass blanket insulation, to a partially completed roof of an industrial building, a carriage 12 is placed on adjacent ones of the purlins 14, 15 in the unfinished roof with the support roller engaging adjacent purlins. A reel of sheet material 55 is mounted on the reel support stanchions 47 and 48 of the reel support 46 by extending the bar 54 through the center of the reel and through the axle openings at the upper ends of the stanchions. The free end of the sheet material is payed out from the reel, forwardly and downwardly and about the support roller 40, and then rearwardly onto the purlins 14, 15. When the sheet applicator has been set up as illustrated in FIG. 1, there will be a platform or hard roof panels 16 adjacent the rear portion of the carriage 12, where the workers will stand. When the workers are ready for applying more sheet material to the purlins 14, 15, a worker 84 will grasp a push pole 80 and move its distal end 81 into the pole receptacle 38 and push with the pole against the receptacle, causing the carriage to move along the lengths of the purlins. Sheet material will pay out from the reel, about the support roller and onto the purlins in response to the forward movement of the carriage along the purlins.

In the meantime, the carriage will be balanced on the support roller 40, able to tilt either forwardly or rearwardly about the support roller. Most of the weight of the assembly is applied behind the support roller 40, between the support roller and the rear of the carriage, so as to tend to tilt the rear of the carriage downwardly, opposite to the direction indicated by direction arrow 86. In response, the front end of the carriage tends to tilt upwardly. However, the purlin engager 60 that is located at the front of the carriage applies its engager hook 63 to the purlin, beneath the upper laterally extending flange 22 and its strengthening flange 24, thereby limiting the upward tilting movement of the front end of the carriage. This holds the rear corners 88 and 89 of the framework 30 suspended above the purlins, causing the entire weight of the carriage to be applied through the support roller 40 downwardly toward edges of the sheet lying on the upper surfaces of the purlins. Moreover, the lever arm applied by the displacement of the weight of the rear end of the carriage and the reel support 46 and reel of sheet material 55 about the support roller 40 amplifies the weight, causing additional force to be applied downwardly by the support roller 40 against the side edges 57 and 58 of the sheet material, firmly holding the side edges of the sheet material against the upper surfaces of the purlins.

The raw weight of the sheet applicator, intensified by the lever arm effect described above, applies such force to the edges of the sheet material that the static friction between the sheet material and the upper surfaces of the purlins firmly holds the sheet material in place on the purlins, avoiding any sag due to weight or wind that might be otherwise encountered by the sheet material.

Even though a tremendous amount of force is applied by the support roller to the sheet material during the normal operation of the sheet applicator 10, the sheet applicator is free to roll along the length of the purlins, but for the friction applied by the purlin engager 60 to the purlin 14. The lever arm applied by the weight of the reel support 46 and reel of sheet material 55 amplifies the force of engagement between the purlin engager and the purlin, so that the purlin engager functions as a brake, holding the sheet applicator in position on the purlins. Again, this tends to avoid the likelihood that the sheet applicator will be moved by wind force, vibration, etc.

When the worker 84 desires to advance the carriage 12 along the lengths of the purlins 15, the push pole 80 is manipulated by the operator 84 so that its distal end is inserted into the pole receptacle or pocket 38 with the intermediate portion 83 of the pole in engagement with the lifting hook 77. The worker then applies a lifting force at the proximal end 82 of the push pole, as indicated by direction arrow 85, thereby tilting the carriage 12 about its support roller 40. When the carriage is tilted, the purlin engager 60 at least partially disengages from the purlin 14, which has the effect of releasing the brake applied between the carriage and the purlin, and the worker then pushes firmly with push pole 80 so that the carriage advances along the purlins. The purlin engager 60 tends to slide along the purlin when the force between it and the purlin is relieved, but the purlin engager still slidably engages the strengthening flange 24 of the purlin to guide the carriage along the purlins. When the carriage has advanced to the desired position, the worker relaxes the force applied to the push pole 80 and removes it from the carriage 12 so that the next to be applied hard roof panels 16 can be installed.

In the event that there is an obstruction to the advancement of the carriage 12 along the lengths of the purlins, the push pole 80 can be used to manipulate the carriage. The purlin engager 60 can be tilted downwardly and laterally by the push pole as shown by the direction arrow 75 of FIG. 6, so that the purlin engager is completely removed from the purlin and the carriage can be tilted or otherwise manipulated so as to avoid the obstruction.

The purlin engager can be completely disengaged from the purlin 14 by depressing the spring loaded positioning finger 65 of the purlin engager and rotating the engager hook 63 to a horizontal attitude, completely disabling the purlin engager. Also, the purlin engager can be adjusted by manipulation of the lock nuts 71 and 72 to reach farther away from or closer to the framework for proper engagement with the purlins, thereby determining the displacement of the rear end of the carriage 12 above the purlins 14 and 15.

The lifting force applied by the purlin engager 60 to the upper laterally extending flange 22 and the strengthening flange 24 of the purlin 14 of the partially completed roof tends to urge the purlin to an upright attitude in which the central web of the purlin 14 is normal to the rafters 18. This assures that the upper surfaces of the purlins will be oriented parallel to the rafters and form a support lattice that is parallel to the upper surfaces of the rafters, assuring that the purlins will present their strongest support configuration to the hard roof panels as they are applied to the roof.

Although a single support roller has been described herein, other carriage support means can be employed to provide the desirable tilt action to the carriage without departing from the invention, such as two or more closely spaced support rollers, skis, and support rollers mounted in a trolley and the framework tiltable about the trolley. Also, while the carriage has been disclosed as having its center of gravity urge the rear of the framework downwardly, the arrangement of the elements can be adjusted so that the center of gravity urges the front of the framework downwardly and the purlin engager is mounted to the rear of the carriage to limit the tilting of the carriage.

Although preferred embodiments of the invention have been disclosed in detail herein, it will be obvious to those skilled in the art that variations and modifications of the disclosed embodiments can be made without departing from the spirit and scope of the invention as set forth in the following claims.

I claim:

1. An applicator for progressively laying sheet material on spaced apart parallel purlins during construction of a roof wherein the sheet material is progressively applied to the purlins and roof panels are applied progressively behind the sheet material, comprising:

a support carriage for mounting on adjacent purlins, said carriage having a front and a rear, carriage support means mounted on said carriage for supporting said carriage on adjacent purlins of a roof, said carriage support means positioned between said front and rear of said carriage so that said carriage is tiltable about said carriage support means, a reel support mounted on said carriage for supporting a reel of sheet material on said carriage, said carriage and said reel support configured so that the center of gravity of said carriage, said reel support and a reel of sheet material supported on said reel support is positioned between said rear of said carriage and said carriage support means, a purlin engager mounted to the front of said carriage for frictionally engaging a purlin on which said carriage support means is mounted when the front of the carriage is tilted up in response to the weight of the carriage acting through its center of gravity.

2. The applicator of claim 1, wherein said purlin engager is shaped to urge the purlin that it engages upwardly.

3. The applicator of claim 1, wherein said purlin engager is hook-shaped for engaging the bottom surface of the upper flange of a purlin.

4. An applicator for progressively laying sheet material on spaced apart parallel purlins during construction of a roof wherein the sheet material is progressively applied to the purlins and roof panels are applied progressively behind the sheet material, comprising:

a support carriage for mounting on adjacent purlins, said carriage having a front and a rear, carriage support means mounted on said carriage for supporting said carriage on adjacent purlins of a roof, said carriage support means positioned between said front and rear of said carriage so that said carriage is tiltable supported about said carriage support means, a reel support mounted on said carriage for supporting a reel of sheet material on said carriage, said carriage and said reel support configured so that the center of gravity of said carriage, said reel support and a reel of sheet material supported on said reel support is positioned between said rear of said carriage and said carriage support means, a purlin engager mounted to said carriage for engaging a purlin on which said carriage support means is mounted, said purlin engager positioned in front of said carriage support means, weight of the carriage, the reel support and a reel of sheet material on the reel support being configured to tilt the front of the carriage upwardly about the carriage support means, and in response to the upward tilting of the front of the carriage the purlin engager frictionally engages the purlin and limits the upward tilting of the front of the carriage, a pole receptacle mounted on said carriage for receiving an end of a pole, and a lifting member mounted on said carriage configured to limit the upward tilting movement of a pole with respect to said carriage, whereby the upward tilting of a pole in the pole receptacle and in said lifting member tilts the carriage about the carriage support means and moves the purlin engager downwardly away from the purlin.

5. The applicator of claim 4, wherein said lifting means comprises a hook mounted on the rear of said carriage configured for engaging a pole at a position displaced from said pole receptacle.

6. An applicator for progressively laying sheet material on spaced apart parallel purlins during construction of a roof wherein the sheet material is progressively applied to the purlins and roof panels are applied progressively behind the sheet material, comprising:

a support carriage for mounting on adjacent ones of the purlins, said carriage having a front and a rear, a support roller mounted on said carriage for supporting said carriage on adjacent purlins of a roof, said support roller positioned between said front and rear of said carriage so that said carriage is tiltable mounted about said support roller, a reel support mounted on said carriage for supporting a reel of sheet material on said carriage, said carriage and said reel support configured so that the center of gravity of said carriage, said reel support and a reel of sheet material supported on said reel support is positioned between said rear of said carriage and said support roller, a purlin engager mounted to said carriage for engaging a purlin on which said support roller is mounted, said purlin engager positioned in front of said support roller, the carriage the reel support and a reel of sheet material on the reel support being configured on said carriage to tilt the front of the carriage upwardly about the support roller so that the purlin engager engages the purlin and limits the upward tilting of the front of the carriage, wherein said purlin engager is configured to apply frictional contact to the purlin in response to the upward tilting of the carriage and retards movement of the carriage along the purlin.

7. An applicator for laying sheet material on adjacent parallel purlins of a roof structure comprising:

a support carriage having opposed first and second ends, a reel support carried by said carriage for supporting a reel of sheet material over said carriage, carriage support means mounted to said carriage configured to engage adjacent purlins of a roof for mounting said applicator on the purlins, said carriage support means positioned between said first and said second ends of said carriage so that said carriage is tiltable supported intermediate its ends about said carriage support means when supported on purlins of a roof, the center of gravity of said applicator positioned between said carriage support means and said second end of said carriage for tilting said first end of said carriage upwardly, a purlin engager mounted on said carriage at said first end of said carriage for engaging a purlin on which the carriage is mounted to limit the upward tilting of said first end of said carriage away from the purlin.

8. The applicator of claim 7, and further including pole receptacle mounted on said carriage for receiving an end of a pole and tilting said carriage.

9. A process of progressively applying sheet material to adjacent purlins during construction of a roof, comprising:

placing a carriage on adjacent purlins with a support roller affixed to the carriage mounted on the purlins, supporting a reel of sheet material on the carriage, moving the carriage along the lengths of the purlins, in response to the carriage moving along the lengths of the purlins, paying out sheet material from the reel of the sheet material about a carriage support means and onto the purlins, applying most of the weight of the carriage and reel of sheet material on one side of the carriage support means so as to tend to tilt the carriage in a first direction about the carriage support means, engaging a purlin on which the carriage support means is mounted with a purlin engager mounted on the other side of the carriage support means to limit the tilting of the carriage in the first direction, tilting the carriage in a second direction about the carriage support means to disengage the purlin engager from the purlin.

10. The process of claim 9 and further including the step of urging the sheet material with the carriage support means against the purlins when the sheet material has been laid on the purlins.

11. The process of claim 9, wherein then step of engaging a purlin with a purlin engager includes the step of holding the carriage with the purlin engager from movement along the purlins.

12. The process of claim 9, wherein the step of engaging a purlin with a purlin engager comprises urging the purlin upwardly.

13. The process of claim 9, wherein the step of engaging a purlin with a purlin engager comprises urging the upper flange of a purlin upwardly.

14. The process of claim 9, wherein the step of moving the carriage along the lengths of the purlins includes the step of pushing the carriage with a pole, and tilting the carriage with the pole to disengage the purlin engager from its purlin.

15. The process of claim 9, wherein the step of engaging a purlin with a purlin engager includes the step of guiding the carriage along the purlins.

16. The process of claim 9, wherein the step of paying out sheet material from the reel of sheet material onto the purlins comprises passing the carriage support means over the sheet material and urging the sheet material with the carriage support means against the purlins.

17. A process of applying sheet material to adjacent purlins during the construction of a roof, comprising:

placing a carriage on adjacent purlins, supporting a reel of sheet material on the carriage, moving the carriage along the purlins, in response to the carriage moving along the purlins, paying out sheet material from the reel of sheet material onto the purlins, tilting the carriage in one direction to stop the movement of the carriage along the lengths of the purlins, and tilting the carriage in the other direction to allow the carriage to continue its movement along the lengths of the purlins.

18. The process of claim 17, wherein the step placing the carriage on the purlins comprises placing a support roller affixed to the carriage on the purlins, and the step of tilting the carriage comprises tilting the carriage about the support roller.

19. An applicator for progressively laying sheet material on spaced apart parallel purlins during construction of a roof wherein the sheet material is progressively applied to the purlins and roof panels are applied progressively behind the sheet material, comprising:

a support carriage for mounting on adjacent purlins, said carriage having a first end and a second end, carriage support means mounted on said carriage for supporting said carriage on adjacent purlins of a roof, said carriage support means positioned between said first end and said second end of said carriage so that said carriage is tiltable intermediate its ends about said carriage support means, a reel support mounted on said carriage for supporting a reel of sheet material on said carriage, said carriage and said reel support configured so that the center of gravity of said carriage, said reel support and a reel of sheet material supported on said reel support is positioned between said second end of said carriage and said carriage support means, a purlin engager mounted to said carriage for engaging and holding said carriage on a purlin on which said carriage support means is mounted, said purlin engager positioned at the first end of said carriage support means, said applicator being configured for the weight of the carriage of the reel support and of a reel of sheet material on the reel support tending to tilt the front of the carriage upwardly about the carriage support means so that the purlin engager engages the purlin and limits the upward tilting of the first end of the carriage.

* * * * *